United States Patent [19]

Davis et al.

[11] 4,449,761

[45] May 22, 1984

[54] TRANSPARENT REFRIGERATOR DOORS WITH FROSTED PRODUCT LOGO THEREON

[75] Inventors: Charles L. Davis, Atlanta; G. Merle Bachman, Stone Mountain, both of Ga.

[73] Assignee: The Coca-Cola Company, Atlanta, Ga.

[21] Appl. No.: 324,683

[22] Filed: Nov. 25, 1981

[51] Int. Cl.[3] ..... A47B 77/08; A47F 3/04

[52] U.S. Cl. ..... 312/116; 312/117; 312/214; 312/236; 312/234.1; 62/252

[58] Field of Search ..... 312/116, 117, 119, 129, 312/45, 214, 234.1, 234.2, 234.3; 62/252

[56] References Cited

U.S. PATENT DOCUMENTS

| | | | |
|---|---|---|---|
| 589,483 | 8/1897 | Rossi | 312/117 |
| 1,382,704 | 6/1921 | Wolf | 312/117 |
| 1,910,773 | 5/1933 | Richter | 312/117 |
| 2,503,419 | 4/1950 | Secunde | 312/116 |
| 3,204,421 | 9/1965 | Jirel | 62/252 |
| 3,346,313 | 10/1967 | Fee | 312/234.1 |
| 3,942,852 | 3/1976 | Anthony | 312/234.3 |
| 3,963,289 | 6/1976 | Pralle | 312/214 |
| 3,986,758 | 10/1976 | Heaney | 312/236 |
| 4,164,361 | 8/1979 | Grimble et al. | 312/116 |
| 4,274,267 | 6/1981 | James et al. | 62/252 |

*Primary Examiner*—Victor N. Sakran

*Attorney, Agent, or Firm*—Birch, Stewart, Kolasch & Birch

[57] ABSTRACT

A frosted logo is provided on the transparent surface of a door panel of a display type refrigeration unit. The logo is positioned such that is appears to be superimposed over the products within the unit thus conveying the effect of coolness associated with the product stored therein. The frost logo effect is achieved by a screen printing technique.

12 Claims, 2 Drawing Figures

TRANSPARENT REFRIGERATOR DOORS WITH FROSTED PRODUCT LOGO THEREON

BACKGROUND OF THE INVENTION

Figure 2:
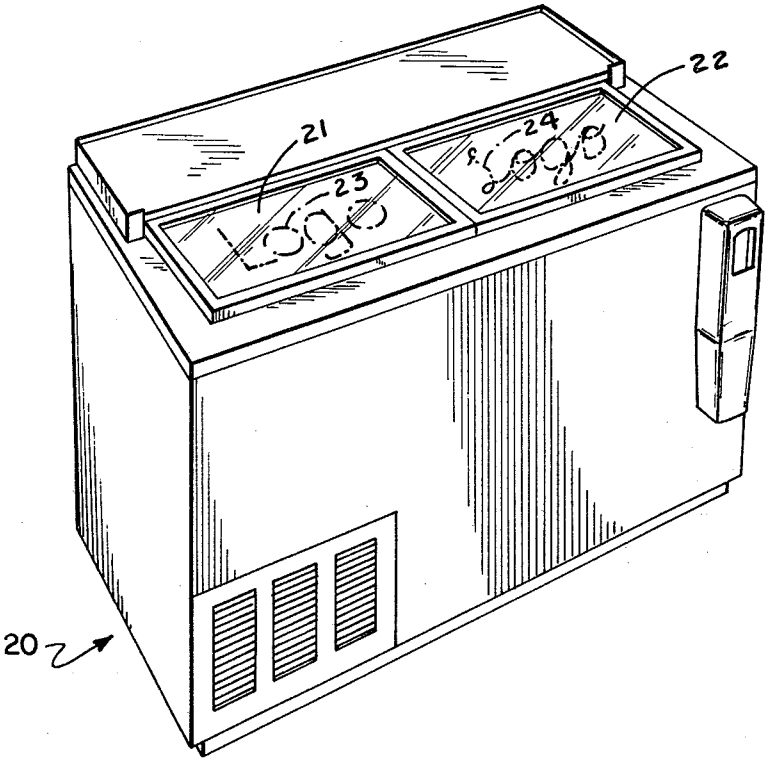

The present invention relates to a commercial display type of refrigeration unit and more specifically to the representation of the products contained therein by imaging the doors of the refrigeration unit with an identifying feature which conveys the feeling of coolness associated with the beverage disposed within the unit.

Various approaches have been tried with consumer products to convey to the user a feeling of refreshness associated with the particular product. For example a frosted appearance has been incorporated into the beverage container housing the product or the glass the consumer uses to drink the product in an attempt to convey the aesthetic effect desired. In these instances, it has been thought, in order to convey the feeling of coolness by the frosted effect, that the affected surface had to be etched, sandblasted or otherwise treated to achieve the desired result, techniques which have been found to be complex and costly. Thus, a more universal approach has been sought to more efficiently and effectively represent a marketable refreshment beverage to the consumer in an appealing and tasteful manner while minimizing the cost and at the same time realizing maximum product identification.

SUMMARY OF THE INVENTION

It is, therefore, an object of the present invention to provide a means of offering to the consumer a beverage associated product in a manner which effectively conveys the lasting impression of coolness and refreshness which will overcome the above-noted and other disadvantages.

It is a further object of the present invention to provide a cabinet for housing or containing a consumer product which includes the logo representing the specific product stored therein.

Another object of the present invention is to provide a frosted logo on a transparent door panel of a commerical display refrigeration unit.

Yet, still another object of the present invention is to provide a commerical display type of refrigeration unit including transparent glass doors having a frosted product-identifying logo thereon to connote the impression or feeling of coolness associated with the beverage disposed within the unit.

A further object of the present invention is to provide a simplified and cost efficient method of fabricating an access panel for a refrigeration unit which serves to display the source of the beverage contained therein while effectively leaving the consumer with a lasting exhilarating impression of the associated product.

Yet, still a further object of the present invention is to provide a frosted logo on the transparent surface of a door panel of a display type refrigeration unit such that the logo is positioned as to appear to be superimposed over the products within the unit, conveying inescapably the overall instant effect of coolness to be associated with the product stored within the refrigeration unit.

The foregoing objects and others are accomplished in accordance with the present invention, generally speaking, by providing a display type refrigeration cabinet for use commercially, having a transparent glass door. Incorporated in the surface of the glass panel of the door is a logo having a frosted appearance. The logo is applied by a conventional screen printing technique by first applying a vinyl decal to a screen substrate in the form of the logo, overlaying the screen on the surface of the glass panel and applying the screening paint which produces the frosted effect. Any suitable approach may be used in the fabrication of the glass panel which incorporates the logo according to the silk screening technique. For example, the logo may be silk screened onto the front surface of a sheet of glass and then a second sheet of glass laminated over the frosted logo image to produce a laminated glass composite. In another embodiment, the logo may be applied in a reverse-image mode on the backside of the front most transparent glass panel of a glass composite which is completed by laminating a second panel over the reverse image. The resulting glass panel door has the logo included therein and may then be assembled together with the respective display type refrigerator unit such as the upright type cooler unit or the floor model.

The invention is further described by way of the accompanying drawings which are merely representative of the present invention and not intended to limit the scope thereof.

Figure 1:
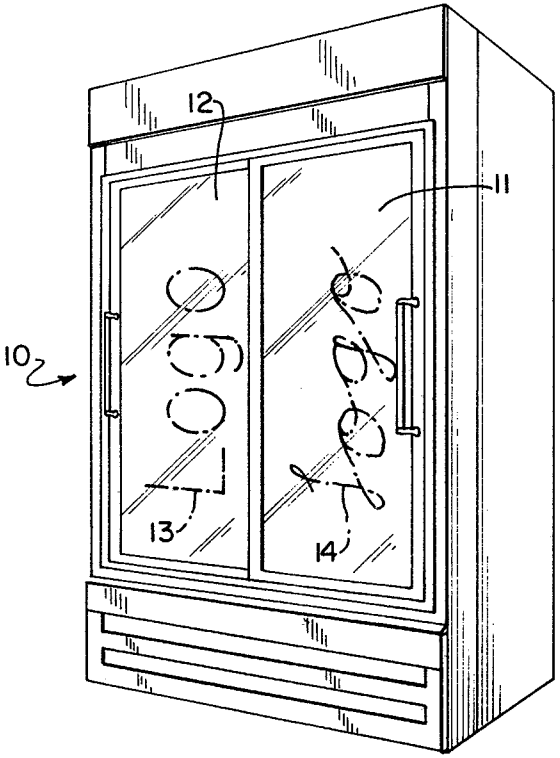

FIG. 1 represents an upright type cooler unit having a door with the logo included therein; and FIG. 2 represents an opened-top floor model cooler unit with the logo incorporated into the lid.

Referring now to FIG. 1 there is seen an upright cabinet unit identified as 10 for housing the beverage containing containers. The unit has transparent glass doors 11 and 12 with the frosted product-identifying logos 13 and 14 displayed thereon representing the source of the product contained therein while at the same time conveying the impression or the feeling of coolness to the customer which is, in turn, associated with a beverage disposed within the cabinet. FIG. 2 represents a horizontally placed display type refrigeration cabinet 20 having the access from the top of the cooler unit by the slideable or hinged lids 21 and 22 having the logos 23 and 24 imprinted in the glass lid panels. Again, the frosted logo is positioned so as to be visually superimposed over the products on the shelves within the refrigeration cabinet leaving the overall aesthetic effect of coolness inescapable to the potential customer.

Although the present invention has been described in terms of applying the frosted logo effect in an imagewise configuration to the transparent glass panel by the silk screening technique, any suitable approach may be utilized to produce the desired result. For example, the image may be applied to the glass by way of selectively etching the logo image in the surface thereof. Alternatively, the frosted image may be separately prepared in the design of the logo, cut accordingly, and the logo itself transferred to and affixed to the backside of a transparent glass panel to ultimately realize the same effect. However, the stencil or silk screen imaging technique is preferred as a cost saving, expedient approach to impart the frosted glass treatment.

Although the display units have been discussed in terms of using glass panels for the doors or lids of the respective units any suitable similarly transparent material may be employed to produce the desired effect of the present invention. For example, synthetic materials such as transparent plastic substrates such as a thin sheet of polyvinyl chloride or lucite may provide the base for the logo imprinted thereon which, depending upon the thickness of the layer, may be used itself as the access panel to the refrigeration unit or, as discussed above, may be laminated with similar materials or onto glass substrates to produce a composite lid or door.

The present invention having thus been described other similar techniques and approaches will occur to those skilled in the art. Any similar such overall design and technique is considered to be included within the scope of the present invention.

We claim:

1. A display type of refrigeration unit for storing a multiplicity of beverage containers of the type having a source-identifying logo thereon, the beverage being of the type generally served chilled, the unit comprising a cabinet open at one side and having means therein for displaying the beverage containers in a manner suitable for use in a commercial environment, and at least one door attached to the cabinet in such a manner as to cover the opening in the cabinet and by relative movement with respect to the cabinet permitting access to beverage containers stored in the cabinet, the door comprising a first transparent substrate having on a first surface thereof the source-identifying logo enlarged so as to extend over a significant portion of the first surface, the source-identifying logo being applied by silk screen and being colored so as to convey to a customer a frosted effect, and a second transparent substrate juxtaposed to the first transparent substrate and incorporating the source-identifying logo therebetween such that an inexpensive construction is provided wherein the frosted source-identifying logo serves to suggest to the customer an impression associated with the cool refreshment of the beverage in the containers stored therein.

2. A display type of refrigeration unit according to claim 1, wherein the first and second transparent substrates comprise a laminated door and wherein the first substrate is disposed on the side of the door abutting the cabinet.

3. A display type of refrigeration unit according to claim 2, wherein the first and second transparent substrates comprise a laminated door and wherein the second substrate is disposed on the side of the door abutting the cabinet.

4. A display type of refrigeration unit according to claim 2, wherein at least one of the transparent substrates is formed of a glass.

5. A display type of refrigeration unit according to claim 2, wherein the unit is an upright type cooler unit.

6. A display type of refrigeration unit according to claim 2, wherein the unit is a chest type cooler unit.

7. A display type of refrigeration unit of the type wherein a cabinet is provided for storing a multiplicity of beverage containers having a source-identifying logo thereon, the beverage being of the type generally served chilled, the cabinet having at least one door for providing customer access to the beverage containers, the door having at least a portion thereof transparent so as to permit customer viewing of the beverage containers stored therein, an enlarged frosted appearing representation of the source-identifying logo being carried on the transparent portion of the door so as to suggest to the customer an impression associated with the cool refreshment of the beverage in the containers stored therein, the improvement in which comprises the door having a first transparent substrate having on a first surface thereof the enlarged source-identifying logo, the source-identifying logo being applied by silk screen and being colored so as to convey to a customer a frosted effect, and a second transparent substrate juxtaposed to the first transparent substrate and incorporating the silk screen source-identifying logo therebetween whereby the desired frosted effect is accomplished inexpensively.

8. A display type of refrigeration unit according to claim 7, wherein the first and second transparent substrates comprise a laminated door and wherein the first substrate is disposed on the side of the door abutting the cabinet.

9. A display type of regrigeration unit according to claim 7, wherein the first and second transparent substrates comprise a laminated door and wherein the second substrate is disposed on the side of the door abutting the cabinet.

10. A display type of refrigeration unit according to claim 7, wherein at least one of the transparent substrates is formed of a glass.

11. A display type of refrigeration unit according to claim 7, wherein the unit is an upright type cooler unit.

12. A display type of refrigeration unit according to claim 7, wherein the unit is a chest type cooler unit.

* * * * *